US007007745B2

(12) United States Patent
Iwasaki et al.

(10) Patent No.: US 7,007,745 B2
(45) Date of Patent: Mar. 7, 2006

(54) CORE STRUCTURE OF HEAT EXCHANGER

(75) Inventors: Mitsuru Iwasaki, Nakano-ku (JP); Shinobu Asakawa, Nakano-ku (JP); Daisuke Matsuda, Nakano-ku (JP); Shouji Tasaka, Nakano-ku (JP); Toshinobu Imamura, Nakano-ku (JP)

(73) Assignee: Calsonic Kansei Corporation, Tokyo (JP)

( * ) Notice: Subject to any disclaimer, the term of this patent is extended or adjusted under 35 U.S.C. 154(b) by 59 days.

(21) Appl. No.: 10/809,484

(22) Filed: Mar. 26, 2004

(65) Prior Publication Data

US 2004/0206489 A1 Oct. 21, 2004

(30) Foreign Application Priority Data

Mar. 27, 2003 (JP) ..... 2003-088761

(51) Int. Cl.
*F28F 9/04* (2006.01)

(52) U.S. Cl. ..... 165/81; 165/83; 165/173

(58) Field of Classification Search ..... 165/81, 165/83, 173, 177
See application file for complete search history.

(56) References Cited

U.S. PATENT DOCUMENTS 4,582,127 A * 4/1986 Moranne ..... 165/83
4,881,594 A * 11/1989 Beamer et al. ..... 165/173
5,664,625 A * 9/1997 Letrange et al. ..... 165/173
6,082,439 A * 7/2000 Kato et al. ..... 165/79
6,161,616 A * 12/2000 Haussmann ..... 165/176
6,651,333 B1 * 11/2003 Letrange et al. ..... 29/890.052

* cited by examiner

*Primary Examiner*—Allen J. Flanigan
(74) *Attorney, Agent, or Firm*—Wenderoth, Lind & Ponack, L.L.P.

(57) ABSTRACT

In a core structure of a heat exchanger, tubes and corrugated fins are alternately arranged between seat plates arranged opposite to each other with a predetermined space interposed therebetween. End portions of the tubes are inserted into tube holes formed respectively in each of the top and bottom seat plates to be fixed. On the seat plates, there are provided connection portions having wall portions slanting from main body portions thereof toward the tube holes. When a thickness of the tubes is 0.13 mm to 0.23 mm, a slant angle θ of the wall portions of the connection portions is set to satisfy: slant angle θ (°)≧25χ(thickness (mm) of sheet plate)+(−125χ(thickness (mm) of tube)+25).

8 Claims, 12 Drawing Sheets

CORE STRUCTURE OF HEAT EXCHANGER

BACKGROUND OF THE INVENTION

1. Field of the Invention

The present invention relates to a core structure of corrugated fins of a heat exchanger having tubes through which coolant flows being fixed to seat plates, the core structure of corrugated fins used for a heat exchanger such as a radiator for a vehicle or the like.

2. Description of the Related Art

A core structure of a conventional heat exchanger is, for example, disclosed in Japanese Patent Laid-open No. Tokkaihei 11-14285 and in Japanese Patent Laid-open No. Tokkaihei 9-318292. This core structure of a conventional heat exchanger has seat plates arranged opposite to each other with a predetermined space interposed therebetween, tubes and corrugated fins arranged alternately between the seat plates, and reinforcements which couple and reinforce both end portions of the seat plates.

FIG. 10 shows an example of the core structure of the conventional heat exchanger. As shown in FIG. 10, two seat plates 101 are coupled and reinforced at their both end portions by reinforcements 104, and tubes 102 and corrugated fins 103 are alternately arranged between the seat plates 101.

Further, as shown in FIG. 11, on the seat plates 101, tube holes 105 for fixing the tubes 102 by insertion and connection portions 106 having wall portions slanting toward the tube holes 105 are formed by burring.

On the other hand, in recent years, as the tubes 102, tubes having partitions 104 inside as shown in FIG. 12 have become the mainstream. Examples of these tubes are disclosed in Japanese Patent Laid-open No. 2002-303496 for example.

Further, seat plates and tubes in recent years are desired to be made thinner in order to improve a heat exchange rate of a heat exchanger.

However, in the core structure of the conventional heat exchanger, when coolant flowing from an engine into a radiator rapidly changes in temperature from low to high as will be described later, large thermal expansion of the tubes 102 and the seat plates 101 occurs, which may cause the connection portions 106 to press the tubes 102 to crack/break root portions of the tubes 102. This has been an obstruction to make the seat plates 101 and the tubes 102 thinner.

Further, since the tubes 102 in which the partitions 104 are formed have a particularly small allowable amount of deformation against an external pressure, a countermeasure has been urgently needed against thermal stress applied by the connection portions 106 of the seat plates 101 to the tubes 102.

Here, the rapid change of coolant flowing from an engine into a radiator in temperature from low to high occurs, for example, in a case when an engine is started in a cold region. In this case, a state that coolant of the engine increases gradually in temperature but does not flow into a radiator continues until it reaches a valve-opening temperature of a thermostat, and then the temperature of the coolant becomes high enough to cause a valve of the thermostat to open, so that the coolant of high temperature flows into the radiator for the first time, or in a case that a so-called hunting phenomenon occurs such that a thermostat repeats opening and closing when driving in a cold region.

The present invention has been made in light of the above-described problems, and an object thereof is to provide a core structure of a heat exchanger capable of preventing a crack and a breakage of root portions of tubes fixed to seat plates due to thermal stress of the seat plates against the tubes when coolant flowing from an engine into a heat exchanger, such as a radiator, rapidly changes in temperature from low to high.

SUMMARY OF THE INVENTION

A core structure of a heat exchanger according to the present invention includes: tubes in which a heat exchange medium flows; corrugated fins adhering to the tubes to radiate heat from the heat exchange medium; and seat plates arranged opposite to each other with a predetermined space interposed therebetween and having the tubes and the corrugated fins arranged alternately therebetween, the sheet seat plates being provided with connection portions having wall portions slanted with a predetermined slant angle from main body portions thereof toward the tubes and tube holes through which the tubes are inserted to be fixed, in which when the tubes have a thickness of 0.13 mm to 0.23 mm, a slant angle θ of the connection portions is: slant angle θ (°)≧25χ(thickness (mm) of sheet plate)+(−125χ(thickness (mm) of tube)+25).

Therefore, in this core structure of the heat exchanger, the slant angle θ of the connection portions is optimally set according to the thickness of the seat plates and the thickness of the tubes so as to satisfy the above-described formula, so that cracking and breaking of the tubes due to thermal stress of the connection portions can be prevented as much as possible, thereby allowing the seat plates and the tubes to be made thinner.

Further, a correlation among the slant angle of the connection portions, the thickness of the seat plates, and the thickness of the tubes can be comprehended using the above-described formula, so that development of thinner seat plates and tubes can be facilitated.

Furthermore, when a burring apparatus for forming the tube holes and the connection portions is not able to form connection portions having a desired slant angle, a thickness of the tubes or the seat plates which is optimum for a slant angle of connection portions formed by the burring apparatus can be set, so that thin tubes with betters durability, as compared to conventional tubes, can be used.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, embodiments of a core structure of a heat exchanger according to the present invention will be described.

Incidentally, in these embodiments, a case that the heat exchanger is an automotive radiator will be described.

Figure 1:
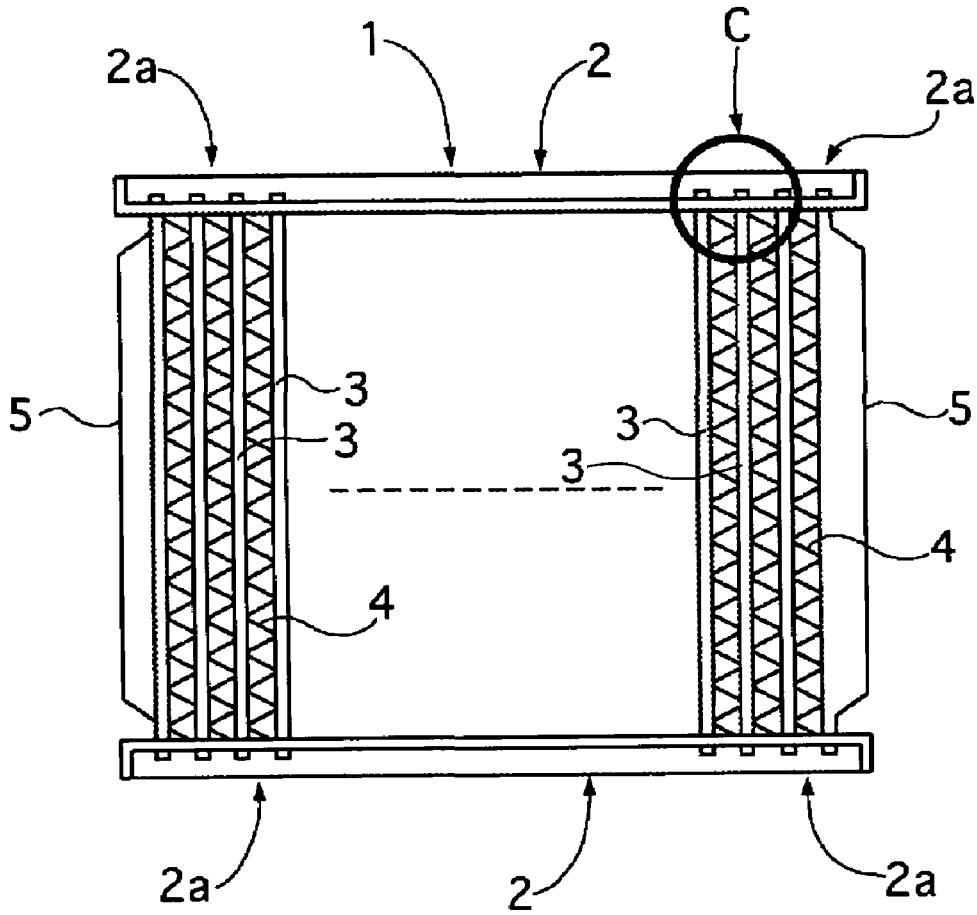
FIG. 1 is a front view showing an entire core structure of a heat exchanger of an embodiment of the present invention.

As shown in FIG. 1, the core structure of a heat exchanger of a first embodiment of the present invention has a pair of seat plates 2 and 2 arranged opposite to each other with a predetermined distance interposed therebetween at top and bottom positions of a radiator 1.

Reinforcements 5 are arranged respectively at both end portions 2*a* of the seat plates and couple the top and bottom seat plates 2. Between the seat plates 2 and the reinforcements 5, tubes 3 and corrugated fins 4 are alternately arranged with a predetermined space interposed therebetween in a direction of the width of the radiator 1.

Figure 2:
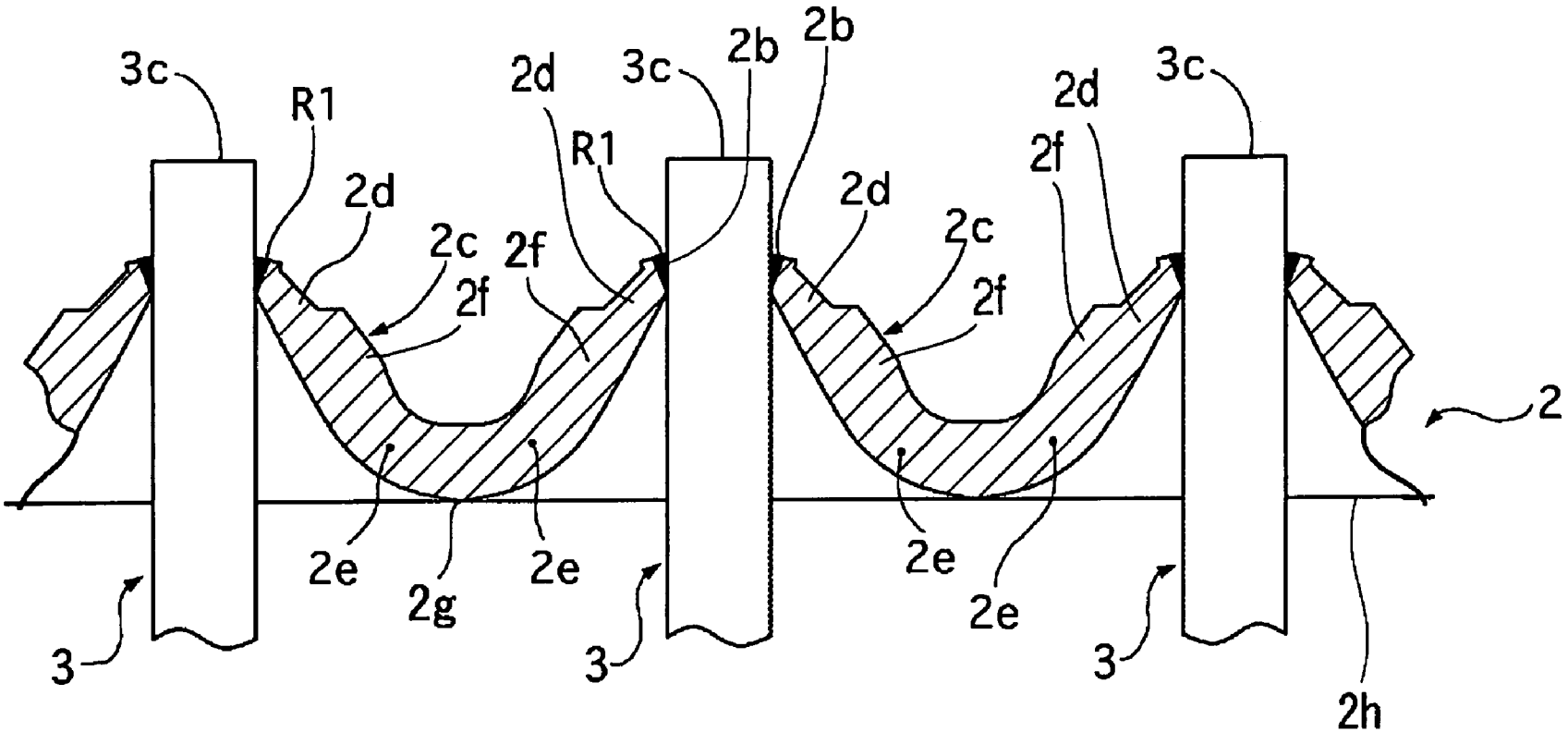
FIG. 2 is an enlarged cross-sectional view of a part indicated by an arrow C in FIG. 1.
Figure 3:
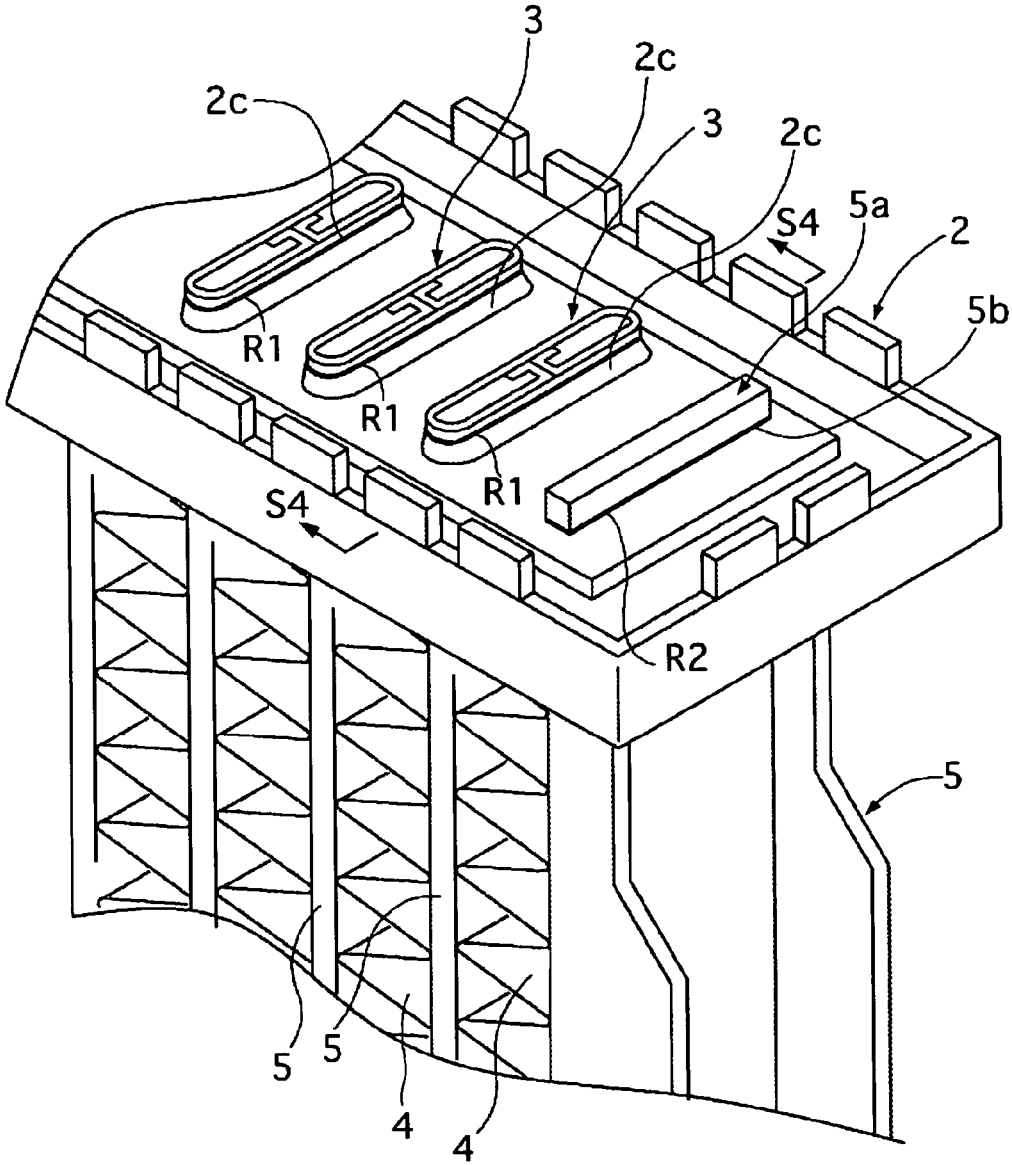
FIG. 3 is an enlarged perspective view of a seat plate and so on in the part indicated by the arrow C in FIG. 1.
Figure 4:
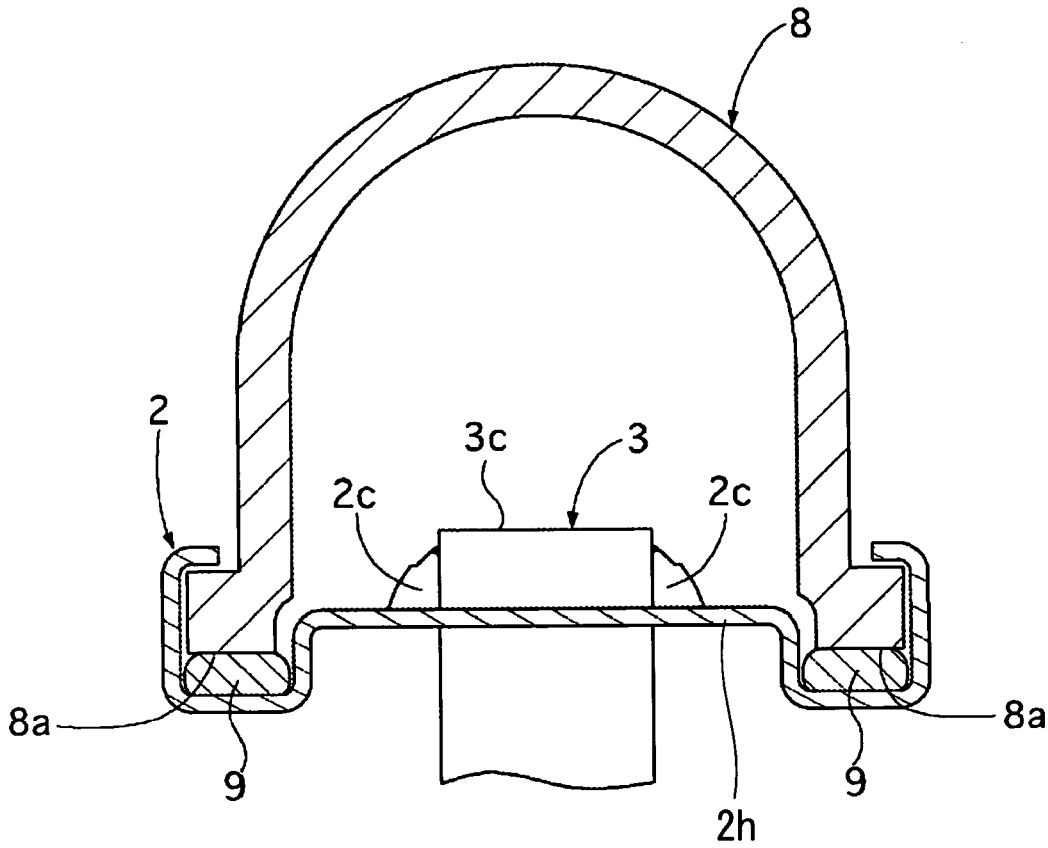
FIG. 4 is a cross-sectional side view taken along S4 to S4 in FIG. 3.

As shown in FIG. 2 to FIG. 4, on the seat plates 2, tube holes 2*b* corresponding to arrangement positions of the respective tubes 3 are formed by burring. Incidentally, in FIG. 2 to FIG. 4, only top side portions of the seat plates 2, the tubes 3, and so on are drawn and bottom side portions thereof are not shown. Regarding the bottom side portions, the bottoms seat plate 2 and the lower end portions of the tubes 3 are fixed in a vertically reverse state of the upper side portions.

As shown in FIG. 2, on main body portions 2*h* of the seat plates 2, connection portions 2*c* having the tube holes 2*b* are formed with a predetermined space. The connection portions 2*c* have wall portions 2*f* in a cup shape slanted toward the tube holes 2*b* into which the tubes 3 are inserted from the main body portions 2*h*, and vulnerable portions 2*d* on side ends of the tube holes 2*b* of the wall portions 2*f* and vulnerable portions 2*e* on end portions of bottom portions 2*g* formed between the tube holes 2*b* are formed in series, respectively. These vulnerable portions 2*d* and 2*e* are thinner than the wall portions 2*f* which have the same thickness as that of the seat plates 2 and are formed with the wall portions 2*f* simultaneously at the time of burring.

The connection portions 2*c* function as a guide to insert a tip of the tube 3 into the tube hole 2*b* when the tubes 3 are assembled with the seat plates 2, and when the seat plates 2 thermally expand, the connection portions 2*c* act so as to absorb thermal stress of the connection portions 2*c* applied to the tubes 3 by bending of the vulnerable portions 2*d* and 2*e*.

In the tube holes 2*b*, both end portions 3*c* of the tubes 3 are fixed by brazes R1 in a state that the both end portions 3*c* are inserted therethrough.

Further, both end portions 5*a* of the reinforcements 5 are fixed by brazes R2 in a state that the both end portions 5*a* are inserted through reinforcement holes 5*b* formed in the seat plates 2.

Incidentally, as shown in FIG. 4, on the outside of the seat plates 2, a tank 8 is arranged with seals 9 interposed therebetween, and lower outer periphery portions 8*a* thereof are fixed to the seat plates 2 by caulking.

Further, in this embodiment, the seat plates 2, the tubes 3, the corrugated fins 4, and the reinforcements 5 are all made of aluminum and integrally assembled in advance, and thereafter they are brazed integrally in a not-shown heat treatment furnace.

Hereinafter, a slant angle of the connection portions 2*c* will be described using FIG. 5.

For the connection portions 2*c* of the first embodiment, a slant angle θ becomes $\theta=\tan^{-1}(LB/(LA/2))$ when the bottom portion 2*g* of the connection portions 2*c* at the center position of a distance LA between the adjacent tubes 3 and 3 is an origin O, a distance in a horizontal direction from this origin O to the tubes 3 is LA/2, and a distance from the origin O to the highest positions of the connection portions 2*c* is LB, and the connection portions 2*c* are formed in a shape which satisfies the following relationship: slant angle θ (°)≧25χ(thickness(mm) of sheet plate)+(−125χ(thickness (mm) of tube)+25) . . . formula 1.

Incidentally, the thickness of the tube in the formula 1 is 0.13 mm to 0.23 mm, for example.

Here, for example, in a first case of a combination of sheet plates (thickness: 1.3 mm) and tubes (thickness: 0.18 mm) made thinner than conventional ones, the connection portions 2*c* are formed to have a slant angle θ of 35° or larger by the formula 1.

Hereinafter, results of experiments performed regarding combinations of other seat plates 2 and tubes 3 with various thicknesses including the first case will be described.

Figure 6:
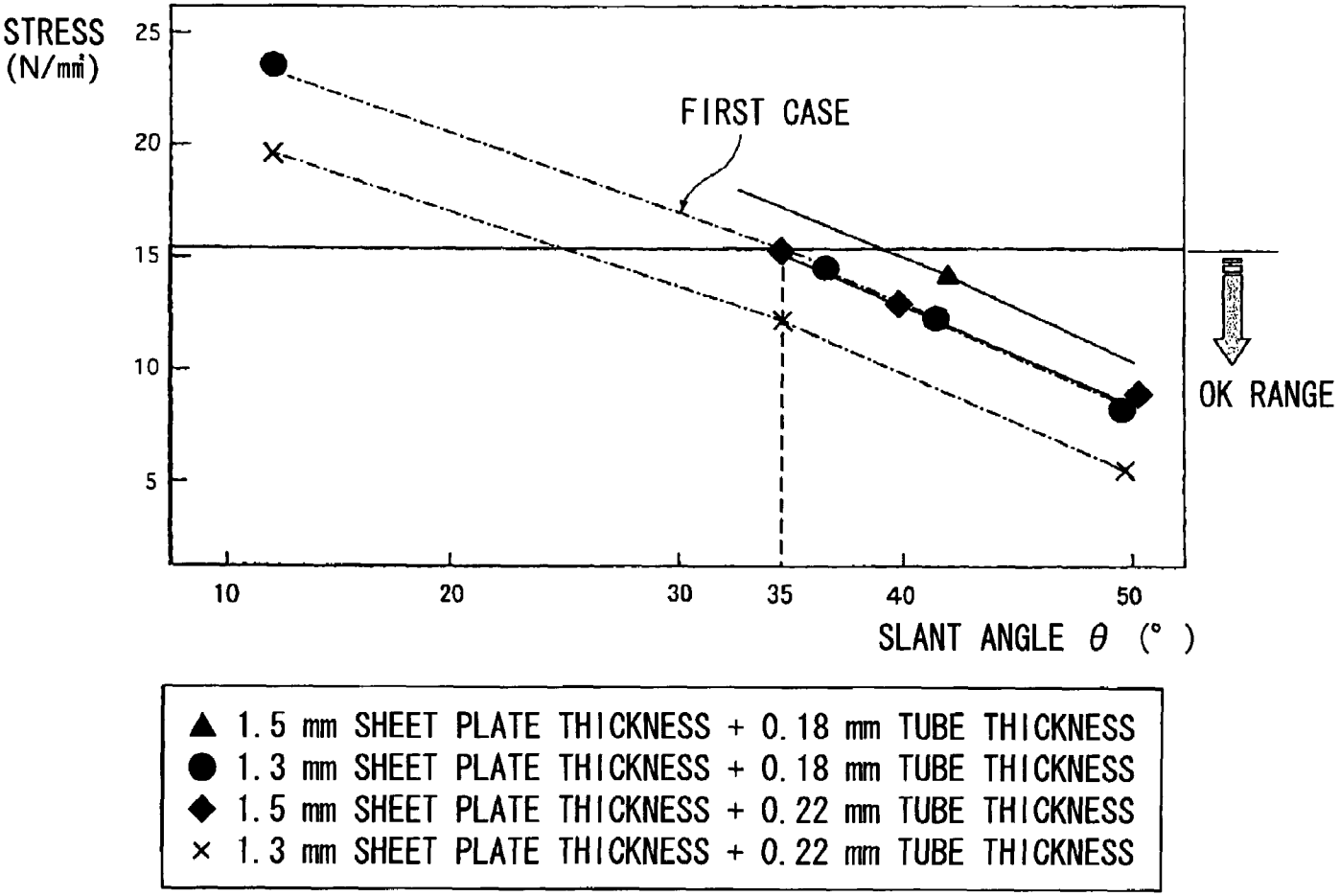
FIG. 6 is a view showing results of thermal stress tests based on a relationship between the slant angle and stress.

FIG. 6 shows measurement results of thermal stress received by the tubes when a slant angle θ of each connection portion 2*c* is varied regarding the combinations of other various seat plates 2 and tubes 3 including the first case.

As shown in FIG. 6, in the first case, when the slant angle is larger than 35°, the thermal stress became substantially 15 $N/mm^2$ or lower, which proves that the combination is capable of adequately enduring a normal usage of a heat exchanger.

Further, as shown in the same view, the same results were obtained by slant angles calculated by the formula 1 for the respective combinations regarding the combinations of other various sheet plates and tubes.

Note that in this first embodiment, the vulnerable portions 2*e* bend to absorb the thermal stress of the connection portions against the tubes, thereby contributing to alleviation of the thermal stress.

Figure 7:
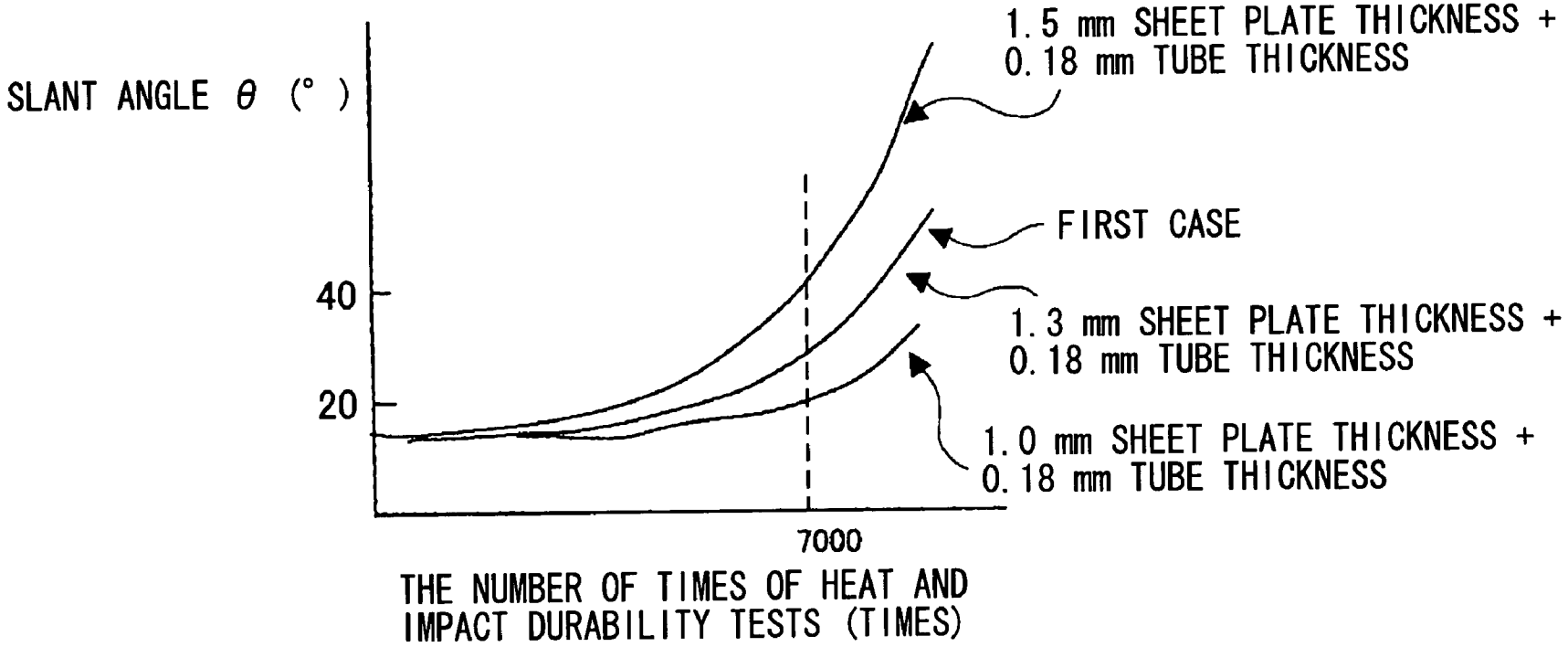
FIG. 7 is a view showing results of heat and impact durability tests based on a relationship between the number of times of heat and impact durability tests and the slant angle.

FIG. 7 shows measurement results of performing heat and impact durability tests in which warm water and cool water are repeatedly made to flow through combinations of tubes (thickness: 0.18 mm) made thinner than conventional ones and seat plates 2 with various thicknesses.

As shown in FIG. 7, in the first case, when the slant angle is larger than 35°, the combination passed the durability tests of approximately 7000 times, which proves that the combination, is capable of adequately enduring a normal usage of a heat exchanger.

Further, as shown in the same view, the same results were obtained by slant angles calculated by the formula 1 for each combination regarding combinations of other seat plates having various thicknesses.

Figure 8:
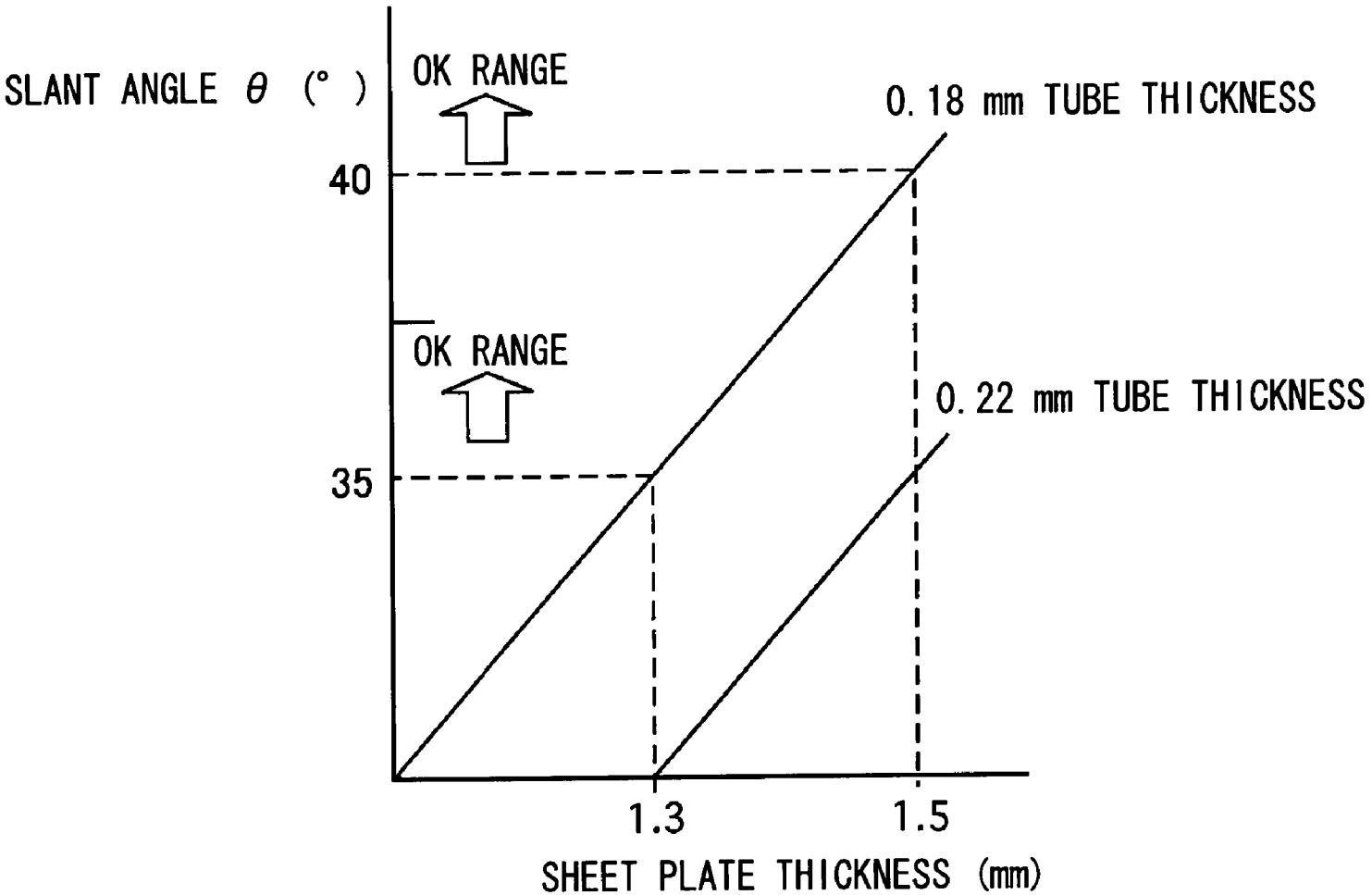
FIG. 8 is a view showing a correlation between test results regarding combinations of various thicknesses of seat plates 2 and tubes 3 and slant angles.

Furthermore, as shown in FIG. 8, a correlation of optimum slant angles of the connection portions of specific sheet plates and tubes can be graphed, which enables the easy obtaining of the optimum slant angle for making the seat plates 2 and the tubes 3 thinner to thereby prevent cracking/breaking of the tubes due to the thermal stress of the connection portions.

Therefore, for the core structure H of the heat exchanger in this embodiment, the formula 1 can be used to easily obtain an optimum slant angle of the connection portions 2*c* according to an average thickness of the connection portions including the vulnerable portions of the seat plates 2 and the thickness of the tubes 3, and in this case, cracking/breaking of the tubes 3 due to the thermal stress of the connection portions 2*c* can be prevented, so that the durability of tubes 3 can be increased as compared to conventional tubes.

Further, by the formula 1, a correlation among the slant angle of the connection portions 2*c*, the thickness of the seat plates 2, and the thickness of the tubes 3 can be comprehended to thereby facilitate making the seat plates 2 and the tubes 3 thinner.

Figure 9:
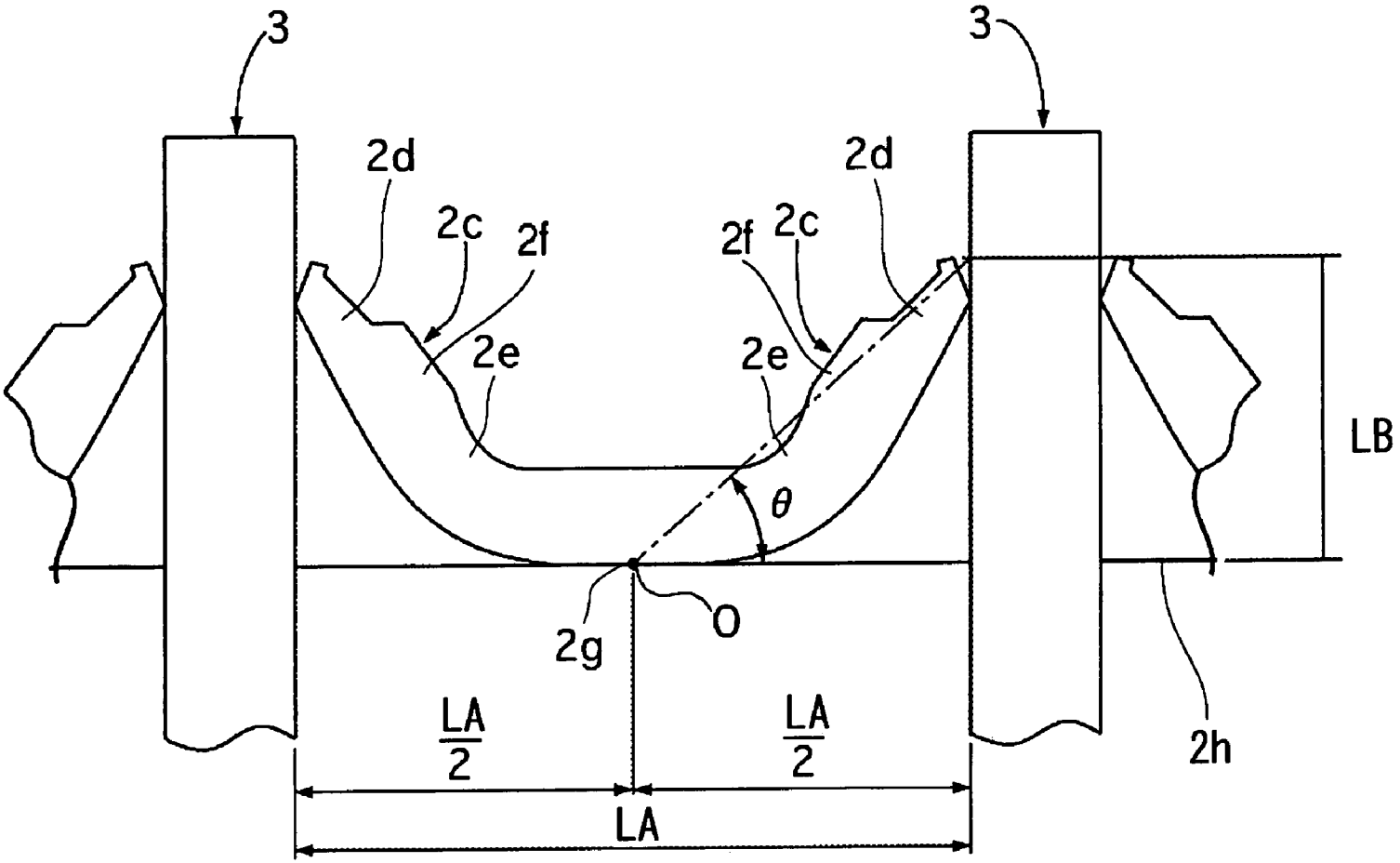
FIG. 9 is a view describing a slant angle at connection portions according to a second embodiment of the present invention.
Figure 10:
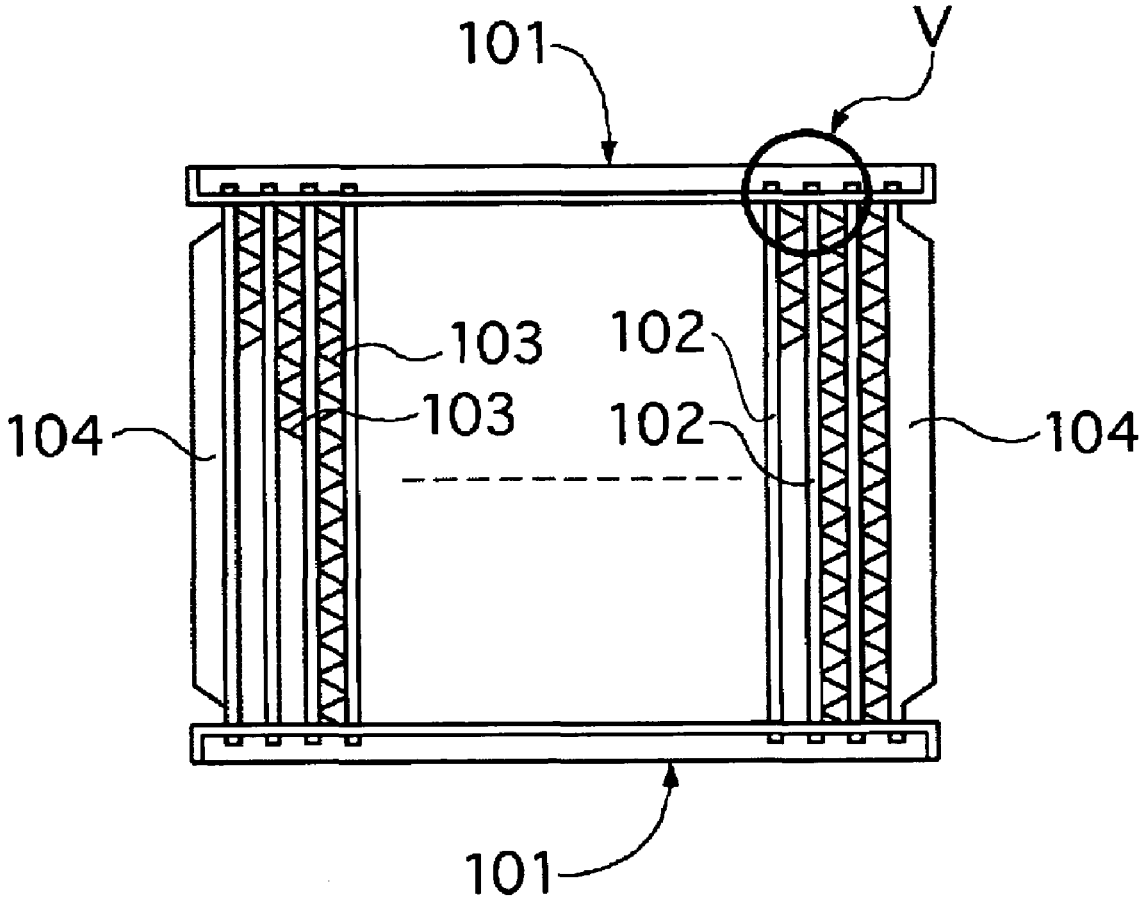
FIG. 10 is a front view showing a core structure of a conventional heat exchanger.
Figure 11:
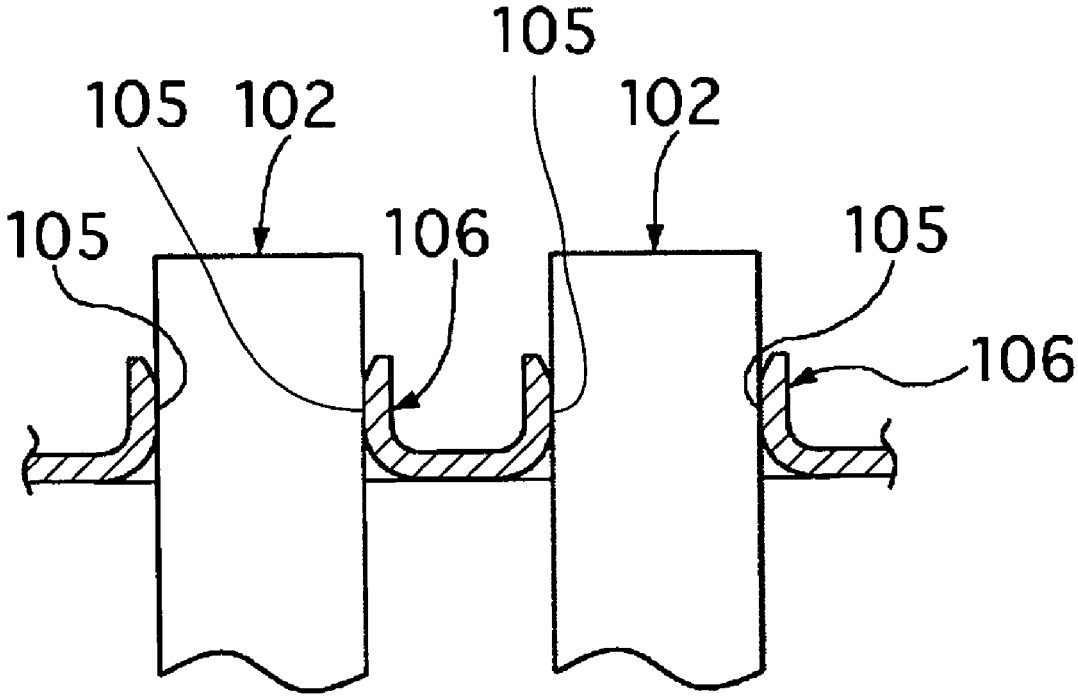
FIG. 11 is an enlarged cross-sectional view of a part indicated by an arrow V in FIG. 10.
Figure 12:
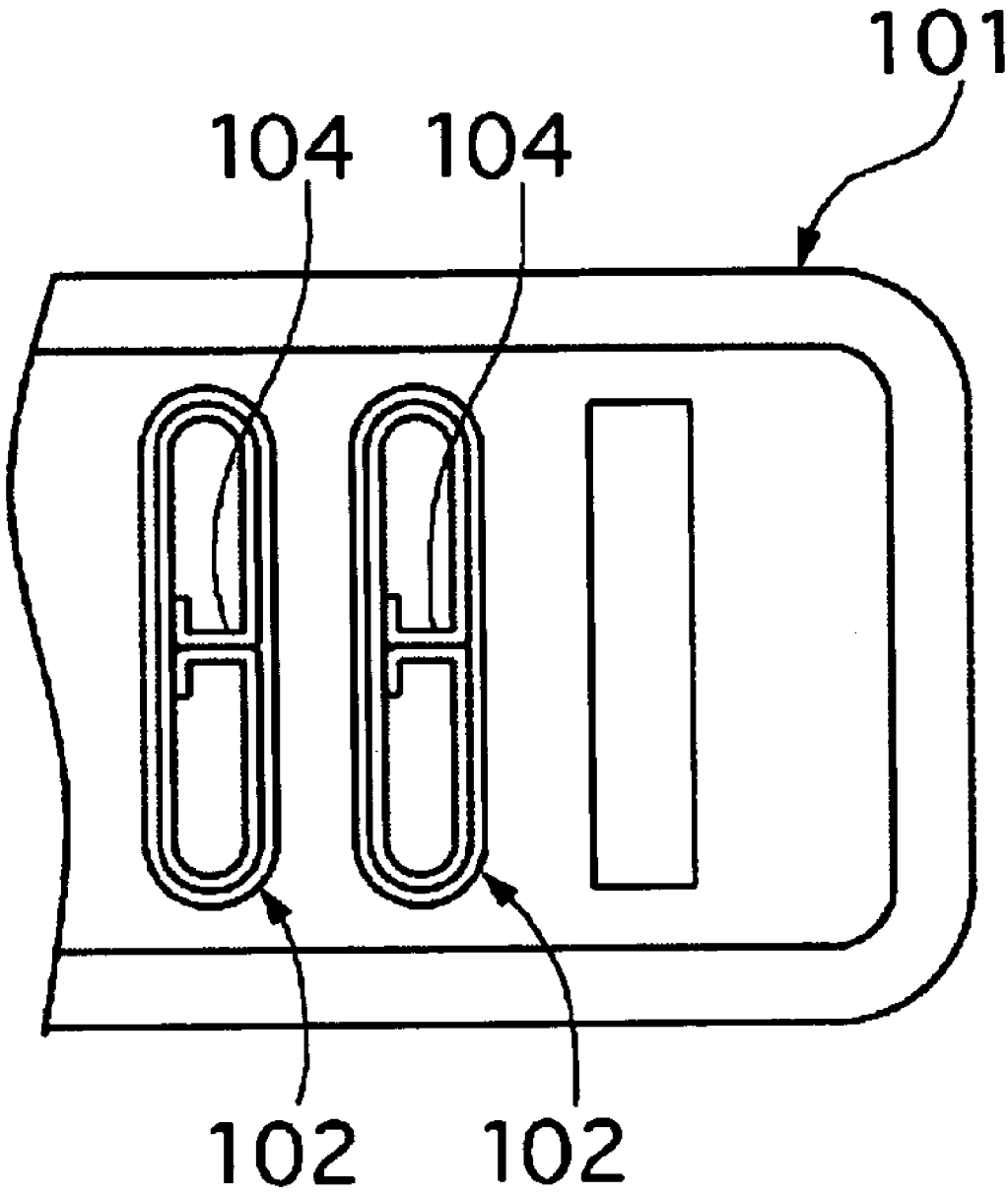
FIG. 12 is an enlarged plan view of the part indicated by the arrow V in FIG. 10.

FIG. 9 shows portions in the vicinity of connection portions 2*c* of a core structure of a heat exchanger according to a second embodiment of the present invention. For these connection portions 2*c*, a bottom portion 2*g* is formed as a flat portion.

Figure 5:
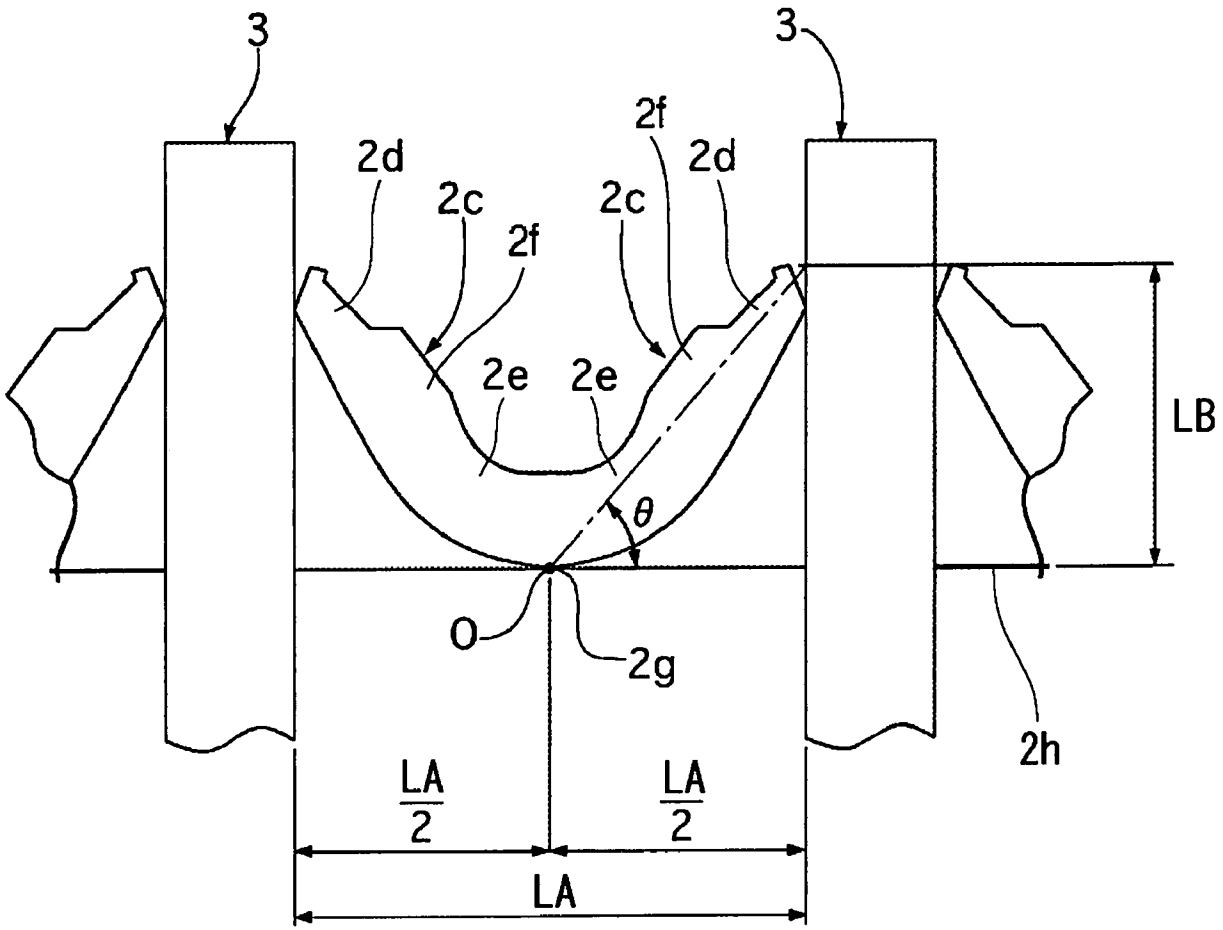
FIG. 5 is a view describing a slant angle of the connection portions.

In this case, similarly to the case described with FIG. 5, an origin O is taken at a position in between adjacent tubes 3 and 3 and in contact with the bottom face of the seat plate 2 to measure a slant angle θ.

Thus, even when the connection portions 2*c* are formed to have a flat portion, the formula 1 is satisfied.

In the foregoing, the embodiments of the present invention have been described, but the specific structure of the present invention is not limited to these embodiments. The present invention includes any change of design in the range not departing from the gist of the invention.

What is claimed is:

1. A core structure of a heat exchanger, the core structure comprising:

a plurality of tubes through which a heat exchange medium is to flow;

a plurality of corrugated fins adhering to said tubes to radiate heat from the heat exchange medium through said tubes; and a plurality of seat plates arranged opposite to each other with a predetermined space interposed therebetween and having said tubes and said corrugated fins arranged alternately therebetween, said seat plates being provided with connection portions having main body portions and wall portions slanted from said main body portions toward said tubes and being formed with tube holes through which said tubes are inserted to be fixed, wherein said tubes have a wall thickness of 0.13 mm to 0.23 mm, and a slant angle θ between the connection portions and the main body portions of said seat plates satisfies the following relationship:

the slant angle θ (°)≧25×(a thickness (mm) of said seat plates)+(−125×(the wall thickness (mm) of said tubes) +25).

2. A core structure of a heat exchanger according to claim 1, wherein said connection portions also have vulnerable portions connected in series with said wall portions, said vulnerable portions being thinner than said wall portions.

3. A core structure of a heat exchanger according to claim 2, wherein said vulnerable portions are formed at at least one of positions between said main body portions and said wall portions and positions between said wall portions and the tube holes.

4. A core structure of a heat exchanger according to claim 2,

Wherein said vulnerable portions comprise first and second vulnerable portions which are thinner than said main body portions and said wall portions and in series on said wall portions, said vulnerable portions being adapted to absorb thermal stress of said seat plates against said tubes by bending, and said first and second vulnerable portions being formed at a position between said wall portions and the tube holes and a position between said main body portions and said wall portions, respectively.

5. A core structure of a heat exchanger according to claim 4, wherein the tube holes are positioned at a position further from said main body portions than said wall portions and said first and second vulnerable portions.

6. A core structure of a heat exchanger according to claim 2, wherein the tube holes are positioned at a position further from said main body portions than said wall portions and said vulnerable portions.

7. A core structure of a heat exchanger according to claim 1, wherein said tubes each have a partition contained therein.

8. A core structure of a heat exchanger according to claim 1, wherein said wall portions are in line-contact with said main body portions.

* * * * *